US005697695A

United States Patent [19]

Lin et al.

[11] Patent Number: 5,697,695

[45] Date of Patent: Dec. 16, 1997

[54] SIGNAL STICK

[76] Inventors: Adam Lin, 5F., No. 260, Chieh Dong Rd., Hsi Chih Chen, Taipei Hsien; Kuo-Tsen Lin, No. 634-9, Chin Pin Rd., Chungho City, Taipei Hsien, both of Taiwan

[21] Appl. No.: 788,413

[22] Filed: Jan. 27, 1997

[51] Int. Cl.[6] ..... F21L 7/00

[52] U.S. Cl. ..... 362/184; 362/102; 362/800; 340/321

[58] Field of Search ..... 362/102, 800, 362/184, 185, 190, 191, 249, 202, 253, 205, 109, 228, 252; 340/321

[56] References Cited

U.S. PATENT DOCUMENTS

| | | | |
|---|---|---|---|
| 2,611,019 | 9/1952 | Warner | 362/102 |
| 5,036,442 | 7/1991 | Brown | 362/800 |
| 5,079,679 | 1/1992 | Chin-Fa | 362/102 |
| 5,081,568 | 1/1992 | Dong et al. | 362/102 |
| 5,622,423 | 4/1997 | Lee | 362/186 |

*Primary Examiner*—James C. Yeung
*Attorney, Agent, or Firm*—Varndell Legal Group

[57] ABSTRACT

A signal stick including a handle holding a battery set, a connector connected to the handle by a screw joint to hold a circuit board, a transparent sleeve coupled to the connector, an inner tube mounted within the transparent sleeve and having a bottom end plugged into an annular top open chamber of the connector and a top end made with locating grooves, a negative metal wire rod and three positive metal wire rods respectively hung on the locating grooves of the inner tube within the transparent sleeve and connected to the circuit board, a plurality of LEDs of different colors respectively connected between the negative metal wire rod and the positive metal wire rods, a selector switch mounted on the connector and adapted for turning on a particular color of LEDs, and a manual/auto control switch shifted between an automatic mode to automatically turn on the LEDs in a predetermined order, and a manual mode to let the LEDs be controlled by the selector switch.

3 Claims, 8 Drawing Sheets

SIGNAL STICK

BACKGROUND AND SUMMARY OF THE INVENTION

The present invention relates to signal sticks adapted for use by traffic policemen, teachers, construction supervisors, etc., in directing traffic, and relates more particularly to such a signal stick which can be controlled to produce a visual signal of a particular light, or to flash different color signals in a predetermined sequence.

FIG. 1 shows a signal stick adapted for use by traffic policemen or the like in directing traffic. This structure of signal stick comprises a positive metal wire rod and a negative metal wire rod respectively connected in parallel to the positive terminal and negative terminal of a control circuit mounted within a connector, and a plurality of red light emitting diodes (hereafter LED) having respective positive contact pins and respective negative contact pins respectively connected to the positive metal wire rod and the negative metal wire rod. This structure of signal stick is still not satisfactory in function. One drawback of this structure of signal stick is that the metal wire rods tend to be forced to oscillate when the signal stick is moved to direct traffic. When the metal wire rods are severely vibrated, they may disconnect from the control circuit, and the LEDs may be forced to disconnect from the metal wire rods. Another drawback of this structure of signal stick is that it can only produce red color of light because only red LEDs are installed. Still another drawback of this structure of signal stick is that the handle is suitable for holding a particular size of battery only.

The present invention has been accomplished to provide a signal stick which eliminates the aforesaid drawbacks. It is one object of the present invention to provide a signal stick which can be controlled to produce red, yellow, or green color light. It is another object of the present invention to provide a signal stick which can be controlled to flash red, yellow and green signals in proper order. It is still another object of the present invention to provide a signal stick which can be alternatively arranged to match different sizes of battery. It is still another object of the present invention to provide a signal stick which can be economically made in different sizes. According to one aspect of the present invention, the signal stick comprises a handle holding a battery set, a connector connected to the handle by a screw joint to hold a circuit board, a transparent sleeve coupled to the connector, an inner tube mounted within the transparent sleeve and having a bottom end plugged into an annular top open chamber of the connector and a top end made with locating grooves, a negative metal wire rod and three positive metal wire rods respectively hung on the locating grooves of the inner tube within the transparent sleeve and connected to the circuit board, a plurality of LEDs of different colors respectively connected between the negative metal wire rod and the positive metal wire rods, a selector switch mounted on the connector and adapted for turning on a particular color of LEDs, and a manual/auto control switch shifted between an automatic mode to automatically turn on the LEDs in a predetermined order, and a manual mode to let the LEDs be controlled by the selector switch. According to another aspect of the present invention, a metal cylinder may be mounted within the handle to hold a relatively smaller size of battery set. According to still another aspect of the present invention, the connector has an inner race adapted for holding a transparent sleeve of a relatively smaller diameter.

DETAILED DESCRIPTION OF THE PREFERRED EMBODIMENT

Figure 1:
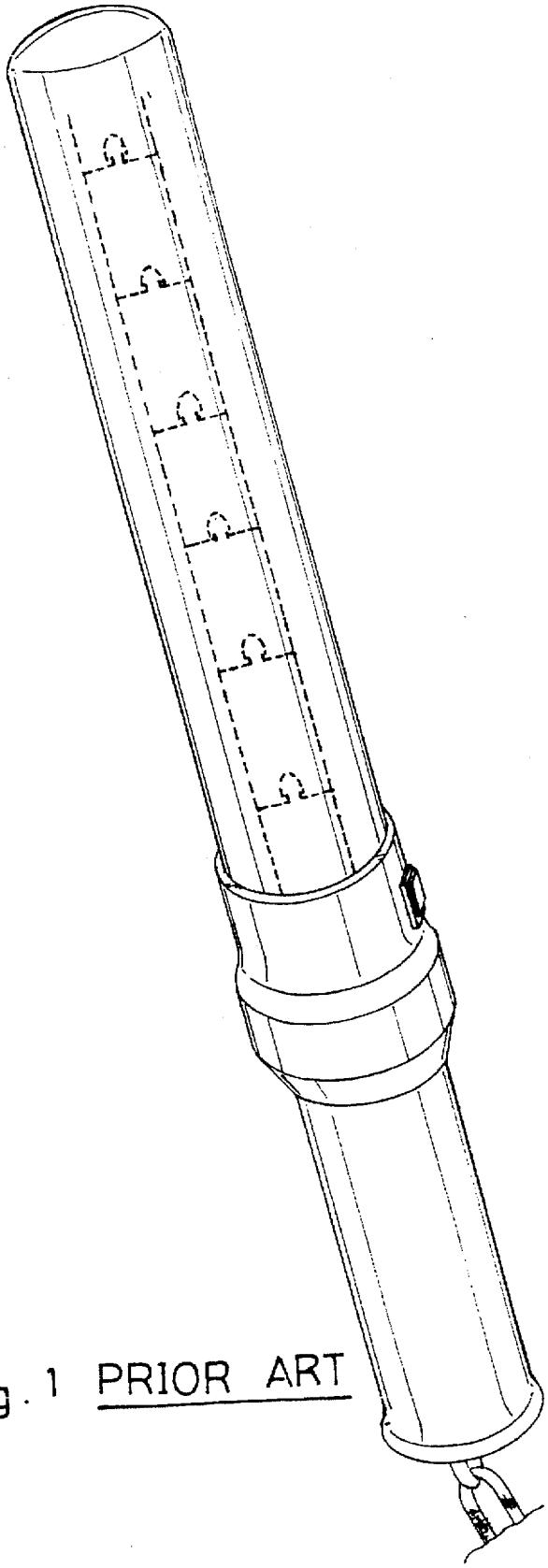
Fig. 1 PRIOR ART
FIG. 1 is a perspective view of a signal stick according to the prior art.

Referring to FIGS. from 2, 4 and 5, a signal stick in accordance with one embodiment of the present invention is generally comprised of a handle 1, a connector 2, a circuit board 3, a locating plate 4, a transparent sleeve 5, cap 50, a red/yellow/green selector switch 6, a battery set 7, positive metal wire rods 71, 72, 73, a negative metal wire rod 74, a plurality of LEDs 81, 82, 83, and a transparent inner tube 9.

Figure 4:
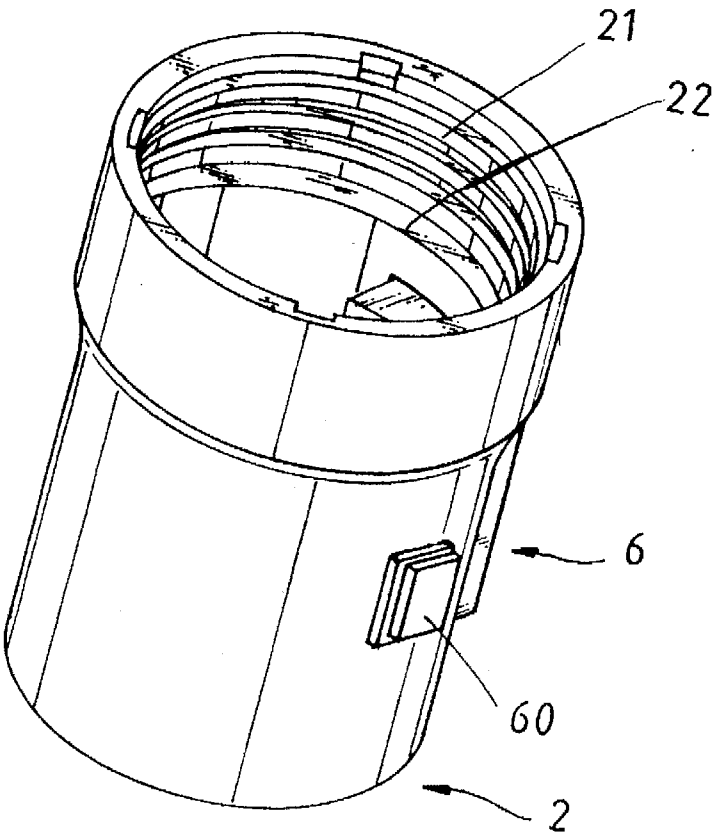
FIG. 4 is an elevational view of an enlarged scale of the connector shown in FIGS. 2 and 3.

The handle 1 is a hollow cylindrical metal casing adapted for holding the battery set 7, having a clip 13 and a rope 12 on the outside at a close bottom end thereof for fastening, an outer thread 15 at an open top end thereof for coupling to the connector 2. The battery set 7 is mounted within the handle 1. The connector 2 is connected between the handle 1 and the transparent sleeve 5, having an inner thread 21 at a bottom end thereof threaded onto the outer thread 15 of the handle 1, an inside annular step 22 disposed adjacent to the inner thread 21 and adapted for holding the locating plate 4 (see FIG. 4), an annular chamber 25 at a top end thereof, an inner race 26 surrounded by the annular chamber 25. The locating plate 4 is mounted on the inside annular step 22 to hold the circuit board 3 inside the connector 2, having a metal contact plate 41 disposed in contact with one terminal (the positive terminal) of the battery set 7. The red/yellow/green selector switch 6 is mounted on the connector 2 at one side. The transparent sleeve 5 has a bottom end coupled to the connector 2, and a top end covered by the cap 50. The transparent inner tube 9 is mounted within the transparent sleeve 5, having a bottom end 92 plugged into the annular chamber 25 of the connector 2 around the inneer race 26, a top end 91 plugged into an inside annular coupling groove 501 of the cap 50, and four locating grooves 911, 912, 913, 914 equiangularly spaced at the top end 91 and adapted for holding the metal wire rods 71, 72, 73, 74. The positive metal wire rods 71, 72, 73 and the negative metal wire rod 74 are respectively inserted into the connector 2, having a respective bottom end adapted for connection to the cirucit board 3 and a respective hooked top end hung on the locating grooves 911, 912, 913, 914. The LEDs 81, 82, 83 include red LEDs 81, yellow LEDs 82 and green LEDs 83. The LEDs 81, 82, 83 have respective positive contact pins 811, 821, 831 respectively connected to the positive metal wire rods 71, 72, 73, and respective negative contact pins 812, 822, 832, respectively connected to the negative metal wire rod 74. By means of shifting the red/yellow/green selector switch 6, the user can selectively turn on the red LEDs 81, the yellow LEDs 82, or the green LEDs 83.

Figure 2:
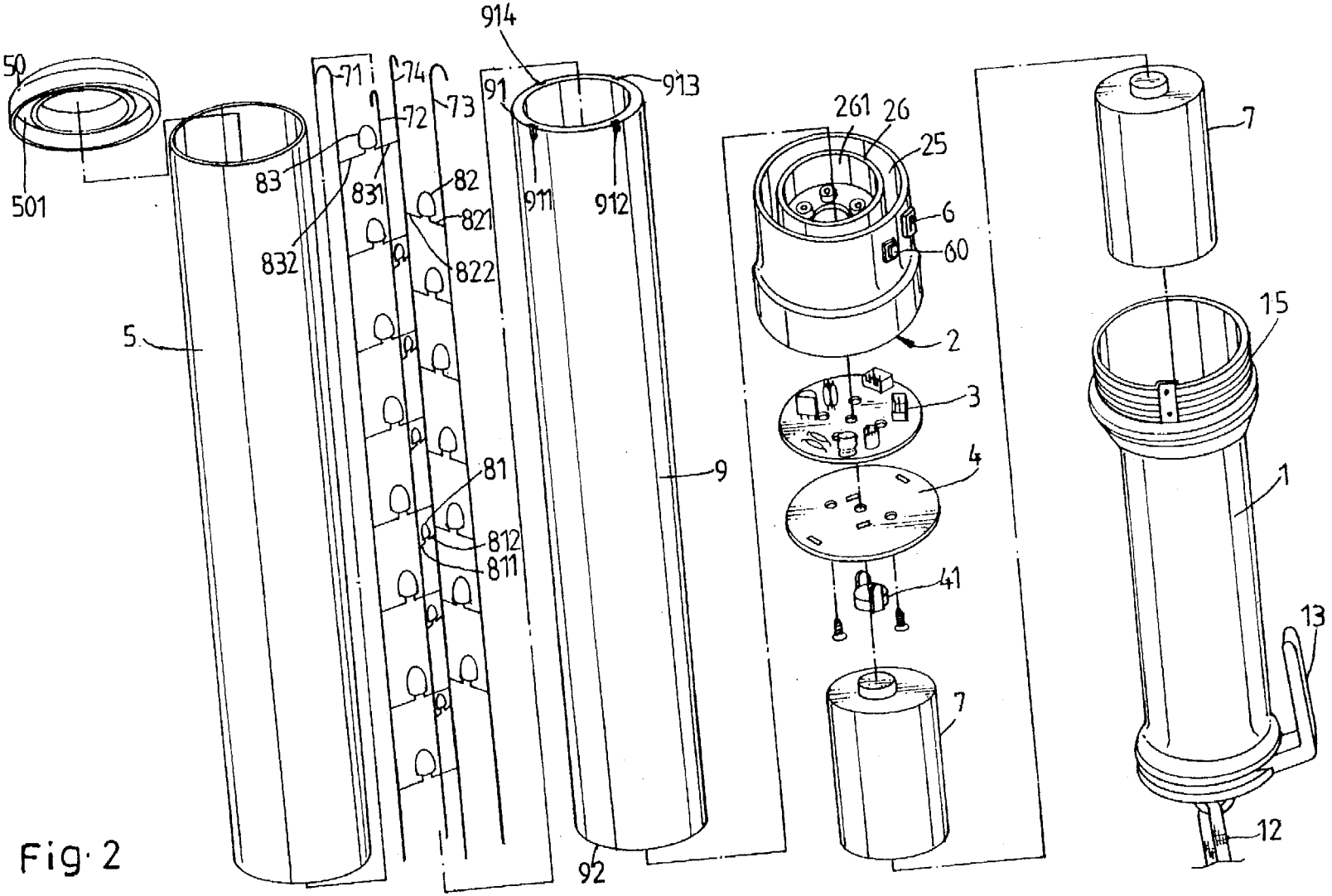
FIG. 2 is an exploded view of a signal stick according to one embodiment of the present invention.
Figure 3:
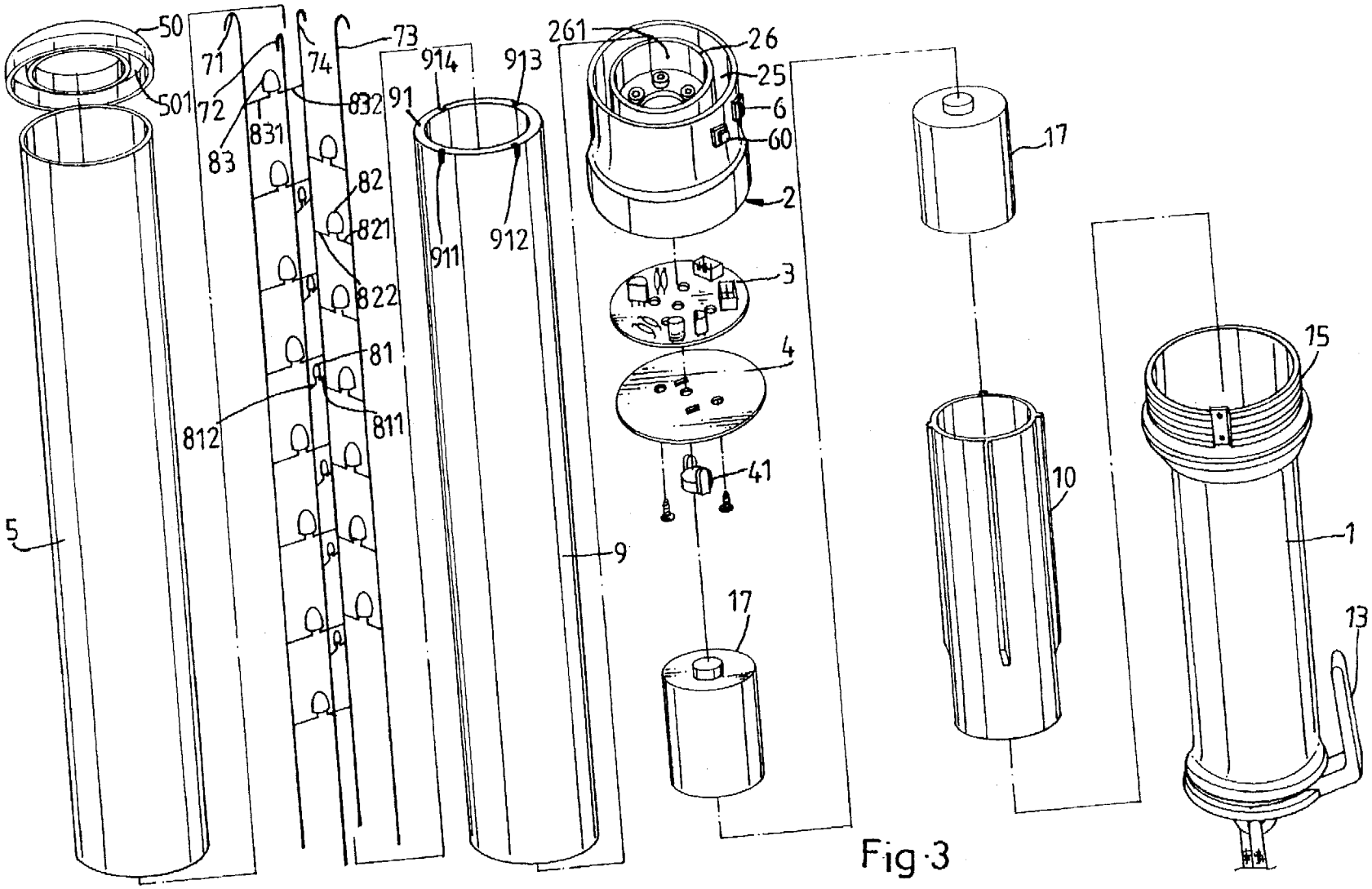
FIG. 3 is an exploded view of a signal stick according to a second embodiment of the present invention.

FIG. 3 is an exploded view of a signal stick according to an alternate form of the present invention. According to this alternate form, a metal cylinder 10 is provided for mounting within the handle 1 to hold a battery set 17 of a relatively smaller size (smaller than that of the battery set 7 shown in FIG. 2), permitting the negative terminal of the battery set 17 to be connected to the negative terminal of the circuit board 3 through the handel 1, and the positive terminal of the battery set 17 to be connected to the positive terminal of the circuit board 3 through the metal contact plate 41.

Figure 5:
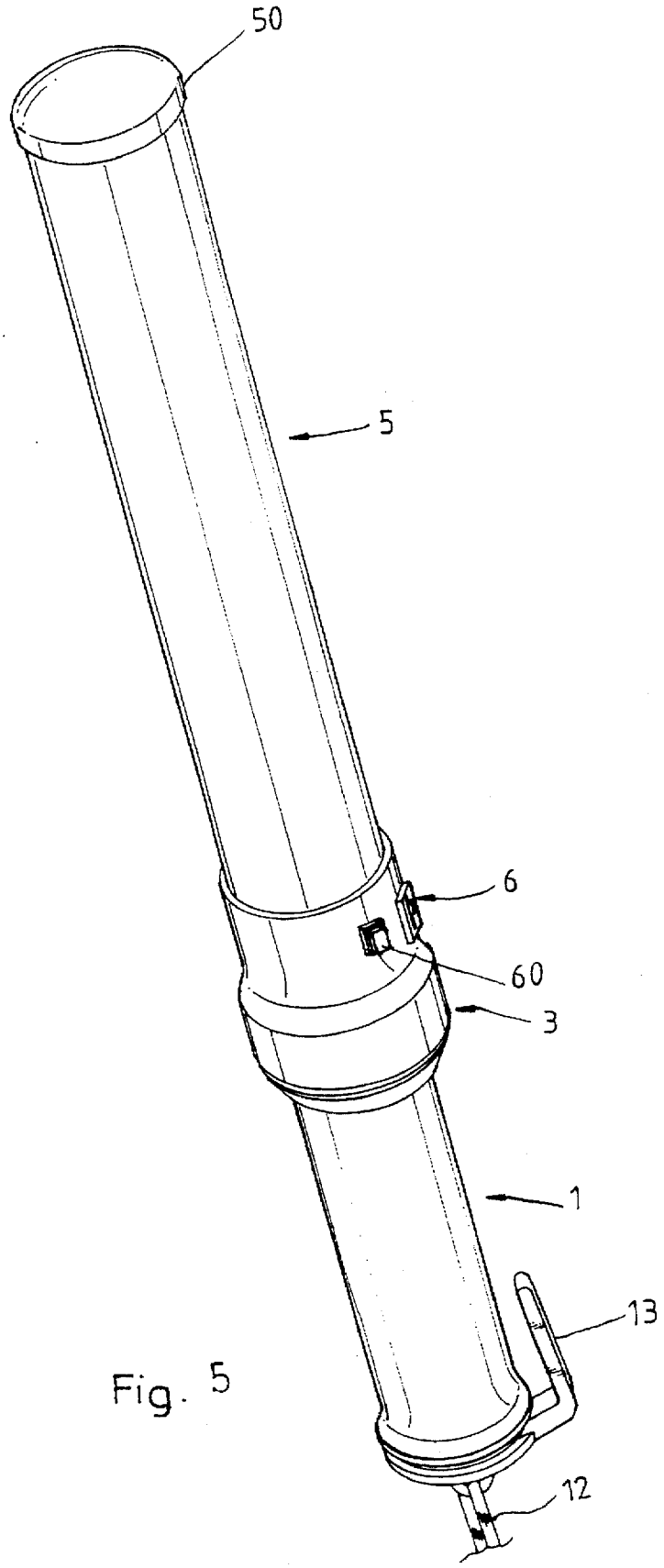
FIG. 5 is an elevational view of a signal stick according to the first embodiment shown in FIG. 2.
Figure 6:
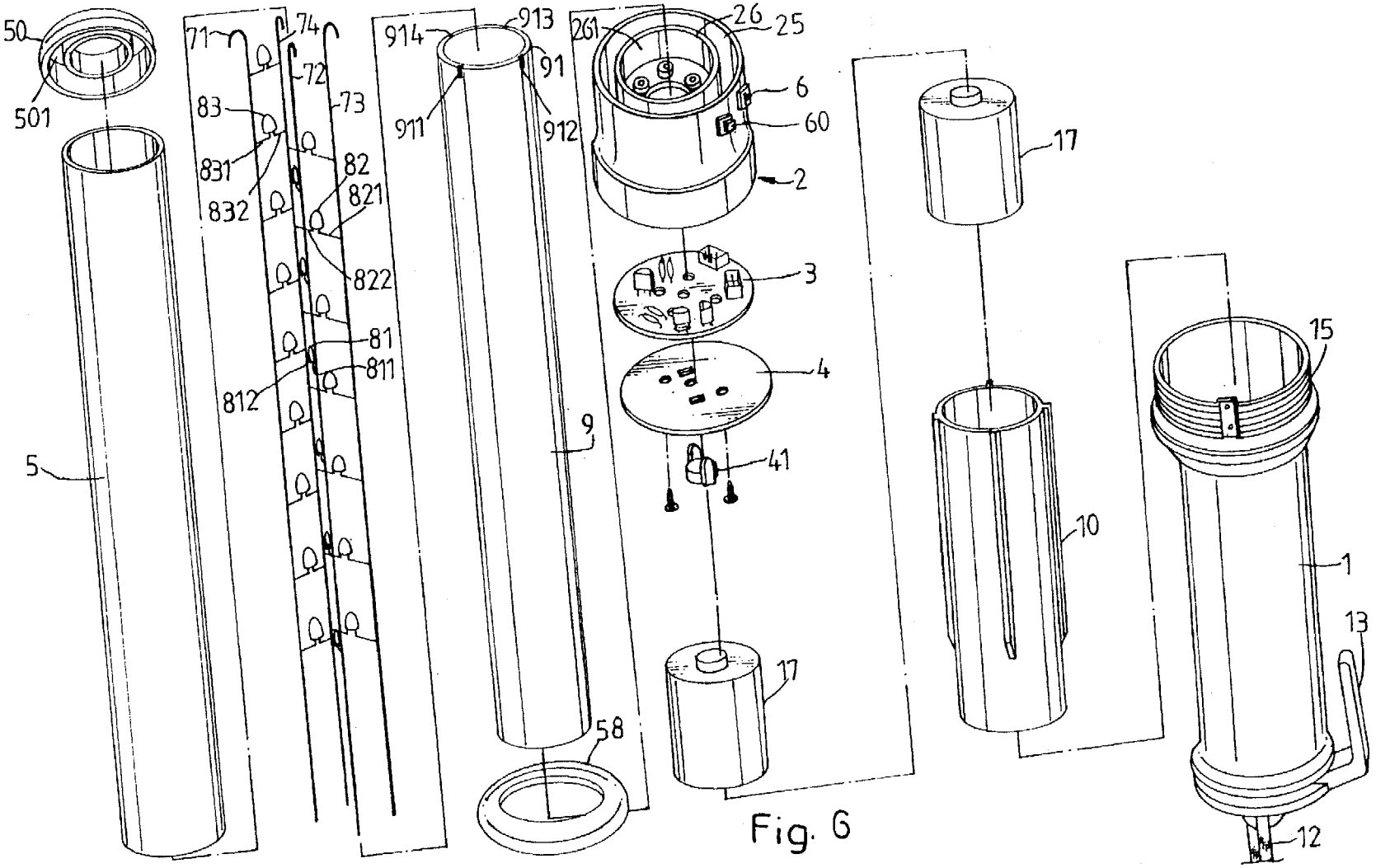
FIG. 6 is an exploded view of a signal stick according to a third embodiment of the present invention.
Figure 7:
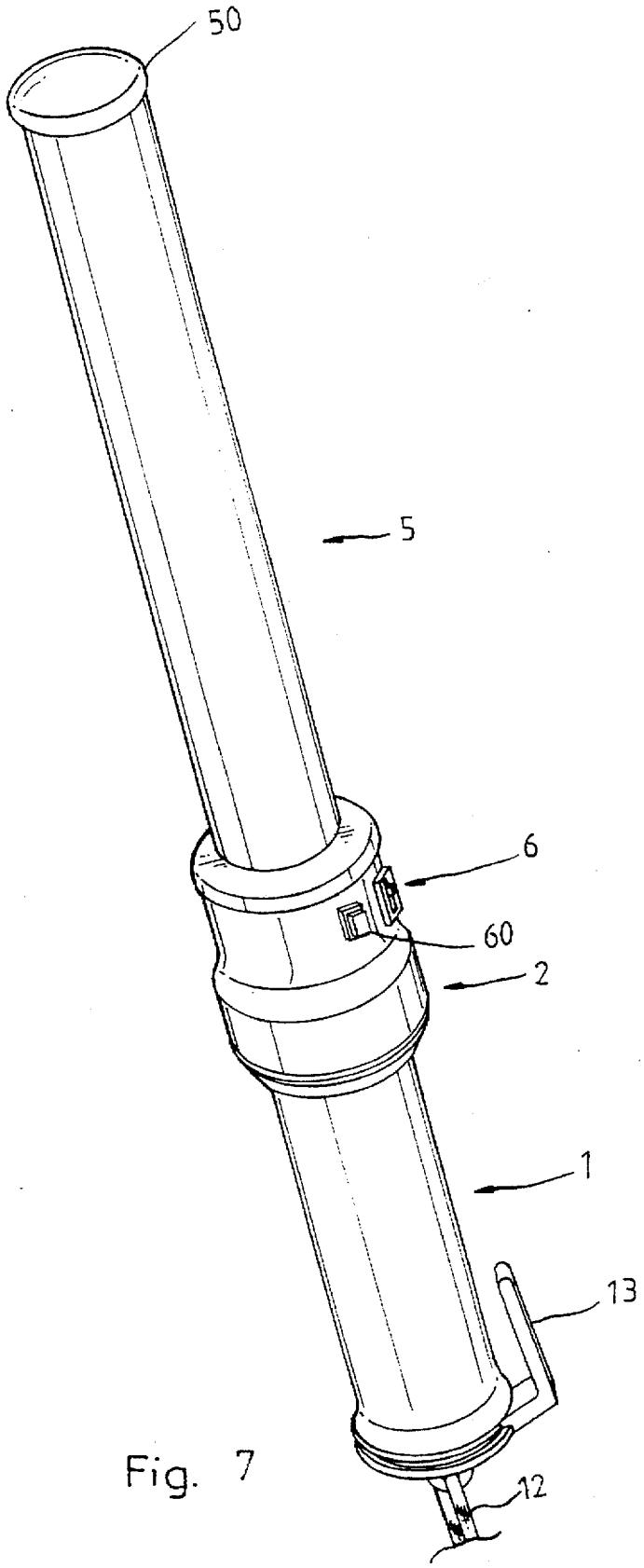
FIG. 7 is an elevational view of a signal stick according to the third embodiment shown in FIG. 6.

FIGS. 6 and 7 show another alternate form of the present invention. According to this alternate form, the diameter of the transparent sleeve 5 is relatively smaller than that of the embodiment shown in FIG. 5; the bottom end of the transparent sleeve 5 is plugged into the inside 261 of the inner race 26 of the connector 2; an ornamental cap 58 is mounted around the transparent sleeve 5 and covered over the annular chamber 25 of the connector 2. Furthermore, light reflecting means (not shown) may be mounted between the transparent sleeve 5 and the transparent inner tube 9 to reflect light.

Referring to FIGS. from 2 to 7 again, a manual/auto control switch 60 is mounted on the connetor 2 adjacent to the selector switch 6 for manual/auto selection control.

Figure 8:
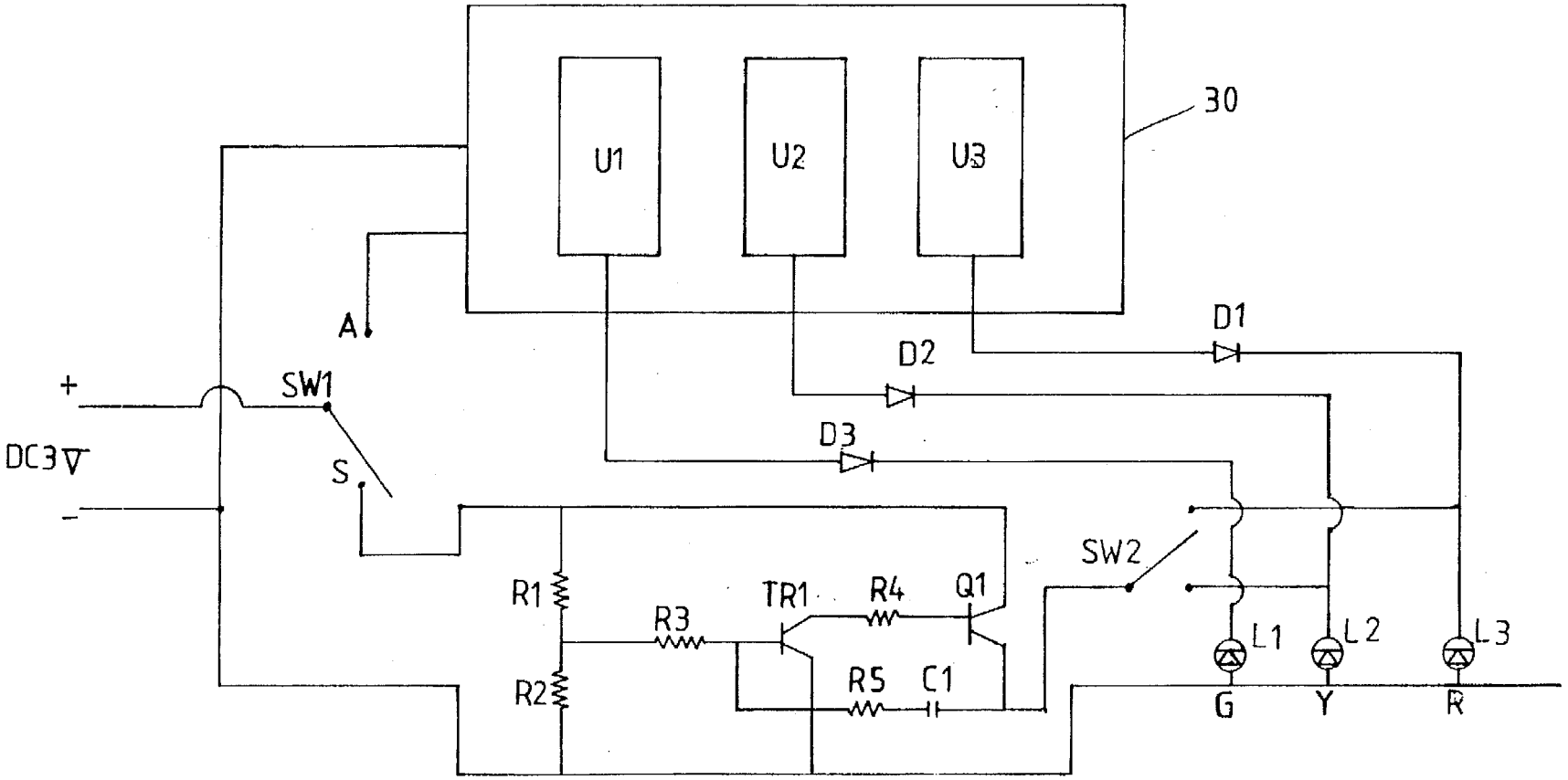
FIG. 8 is a circuit diagram of the present invention.

Referring to FIG. 8, when the switch SW1 (the aforesaid manual/auto control switch 60) is switched to the auto mode, electric current is transmitted through a timer circuit 30 to the LEDs, causing the red LEDs and the yellow LEDs and the green LEDs to be alternatively turned on and off. When the switch SW1 is switched to the manual mode, electric current is transmitted through TR1, Q1 to the LEDs via the switch SW1 (the aforesaid red/yellow/green selector switch 6), permitting the red LEDss, the yellow LEDs and the green LEDs to be selectively turned on by hand.

We claim:

1. A signal stick comprising:

a hollow cylindrical metal handle;

a battery set mounted within said handle;

a hollow cylindrical connector having a bottom end fastened to said handle by a screw joint;

a circuit board mounted within said connector and turned with said connector into electrical contact with said battery set;

a transparent sleeve having a bottom end connected to said connector and a top end covered with a cap;

a plurality of metal wire rods mounted within said transparent sleeve and respectively connected to positive and negative terminals of said circuit board;

a plurality of LEDs having respective positive contact pins and negative contact pins respectively welded to said metal wire rods;

switch means mounted on said connector and connected between said circuit board and said metal wire rods and controlled to turn on said LEDs;

wherein said connector comprises an annular top open chamber and an inner race surrounded by said annular top open chamber; the cap of said transparent sleeve has an inside annular coupling groove; an inner tube is mounted within said transparent sleeve to hold said metal wire rods in place, having a bottom end plugged into the annular top open chamber of said connector, a top end plugged into the inside annular coupling groove of the cap of said transparent sleeve, and four equiangularly spaced locating grooves at the top end; said metal wire rods have a respective hooked top end respectively hooked on the locating grooves of said inner tube and include a first positive metal wire rod, a second positive metal wire rod, a third positive metal wire rod, and a negative metal wire rod, said negative metal wire rod having a bottom end connected to the negative terminal of said circuit board, said first, second and third positive metal wire rods having a respective bottom end alternatively connected to the positive terminal of said circuit board by said switch means; said LEDs include a plurality of red LEDs having a respective positive metal contact pin connected to said first positive metal wire rod and a respective negative metal contact pin connected to said negative metal wire rod, a plurality of yellow LEDs having a respective positive metal contact pin connected to said second positive metal wire rod and a respective negative metal contact pin connected to said negative metal wire rod, and a plurality of green LEDs having a respective positive metal contact pin connected to said third positive metal wire rod and a respective negative metal contact pin connected to said negative metal wire rod; said switch means comprises a red/yellow/green selector switch controlled to connect to positive terminal of said circuit board to one positive metal wire rod, and a manual/auto control switch shifted between an automatic mode to automatically connect said positive metal wire rods to the positive terminal of said circuit board in a set order, and a manual mode to let said positive metal wire rods be alternatively and manually connected to the positive terminal of said circuit board by said red/yellow/green selector switch.

2. The signal stick of claim 1 further comprising a metal cylinder adapted for mounting in said handle to hold a relatively smaller size of battery set.

3. The signal stick of claim 1 wherein said inner race of said connector defines a coupling hole adapted for holding a transparent sleeve of relatively smaller diameter.

* * * * *